US010508844B2

(12) United States Patent
Bartley et al.

(10) Patent No.: US 10,508,844 B2
(45) Date of Patent: Dec. 17, 2019

(54) EVAPORATOR WITH REDIRECTED PROCESS FLUID FLOW

(71) Applicant: TRANE INTERNATIONAL INC., Davidson, NC (US)

(72) Inventors: James M. Bartley, La Crosse, WI (US); Justin D. Piggush, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 393 days.

(21) Appl. No.: 15/395,466

(22) Filed: Dec. 30, 2016

(65) Prior Publication Data

US 2018/0187933 A1 Jul. 5, 2018

(51) Int. Cl.

| | |
|---|---|
| ***F25D 17/06*** | (2006.01) |
| ***F25B 39/02*** | (2006.01) |
| ***F28D 7/00*** | (2006.01) |
| ***F28D 7/16*** | (2006.01) |
| ***F28D 1/053*** | (2006.01) |
| *F28D 21/00* | (2006.01) |

(52) U.S. Cl.

CPC ..... *F25B 39/028* (2013.01); *F28D 1/05325* (2013.01); *F28D 7/0075* (2013.01); *F28D 7/1607* (2013.01); *F28D 2021/0071* (2013.01); *F28F 2250/06* (2013.01)

(58) Field of Classification Search

CPC ..... F25B 39/028; F25B 2339/0242; F28D 1/05325; F28D 7/0075; F28D 7/1607; F28D 2021/0071; F28F 2250/06

See application file for complete search history.

(56) References Cited

U.S. PATENT DOCUMENTS

| | | | | |
|---|---|---|---|---|
| 714,703 | A | 12/1902 | Ibert | |
| 6,161,613 | A | 12/2000 | Huenniger | |
| 9,347,715 | B2 * | 5/2016 | Schreiber | F25B 39/028 |

FOREIGN PATENT DOCUMENTS

| | | | |
|---|---|---|---|
| FR | 1175653 | A | 3/1959 |
| JP | H01-218632 | A | 8/1989 |

OTHER PUBLICATIONS

Extended European Search Report; European Patent Application No. 17210430.9, dated May 23, 2018 (8 pages).

* cited by examiner

*Primary Examiner* — Henry T Crenshaw
*Assistant Examiner* — Kamran Tavakoldavani
(74) *Attorney, Agent, or Firm* — Hamre, Schumann, Mueller & Larson, P.C.

(57) ABSTRACT

An apparatus, system, and method of separating and directing process fluid flow via the use of both low pressure drop pipes and high performance tubes within a refrigerant evaporator are disclosed. The evaporator includes a shell; the shell includes a process fluid inlet and a process fluid outlet. The evaporator also includes a plurality of tubes disposed within the shell and carrying a process fluid; the plurality of tubes includes a first plurality of tubes and a second plurality of tubes. The evaporator further includes a plurality of redirect pipes disposed within the shell and carrying the process fluid; the plurality of redirect pipes includes a first redirect pipe and a second redirect pipe. The evaporator functions by separating and directing process fluid flow into two portions via the use of both tubes and redirect pipes.

14 Claims, 9 Drawing Sheets

EVAPORATOR WITH REDIRECTED PROCESS FLUID FLOW

FIELD

This disclosure relates generally to refrigerant evaporators. More specifically, the disclosure relates to an apparatus, system, and method of separating and directing the process fluid flow via the use of both redirect pipes and heat exchange tubes within a refrigerant evaporator.

BACKGROUND

A shell-and-tube flooded type evaporator has a shell; the shell has a bottom and defines a space. A group of tubes are arranged near the bottom of the shell of the evaporator and extend horizontally from one end of the shell to the other end. The group of tubes is used to carry process fluid which passes through the shell from a process fluid inlet to a process fluid outlet. Refrigerant, as the working fluid, enters the shell of the evaporator from a refrigerant inlet, for example, near the bottom of the shell, exchanges heat with the process fluid and is vaporized. The refrigerant vapor enters an upper portion of the space in the shell and leaves the shell via a refrigerant outlet which can be positioned at an upper portion of the space in the shell.

In the shell-and-tube flooded type evaporator, the number of tubes, the material, length, and performance characteristics of the tubes are carefully chosen to provide the proper heat transfer as well as to reduce cost, reduce the process fluid pressure drop, and reduce the amount of refrigerant charge. In a two-pass shell-and-tube flooded type evaporator, a typical configuration of the tubes has process fluid flowing first in a direction away from the process fluid inlet and then in a direction back toward the process fluid inlet to flow through the outlet. This arrangement places both the process fluid inlet and the process fluid outlet at the same end of the shell of the evaporator.

The size of the shell of the evaporator typically is set large enough to accommodate the tubes so that refrigerant vapor exiting at the top of the shell does not have undesired interactions such as liquid carry-over, heat exchange imbalance, and/or certain local flow velocities with the process fluid flowing in the tubes near the bottom of the shell. The size of the evaporator may also be set by other features of the chiller, for instance the compressor. Various loads for the compressor may require different sizes of the evaporator shell.

SUMMARY

As higher performance tubes are utilized within the evaporator, more vapor is generated near the process fluid inlet at one end of the evaporator, where the temperature difference between the process fluid and the refrigerant may be the greatest. At the end of the evaporator where the process fluid inlet is located, vapor velocities are often relatively higher than vapor velocities at the other end of the evaporator and where liquid refrigerant may be susceptible to be carried over the top of the tube bundle and passed into the compressor. The liquid refrigerant evaporates inside the compressor can disrupt vapor flows and cause undesirable losses. For example, the liquid refrigerant going into the compressor may flash into vapor at some location along the flow path in the compressor when, for example, the enthalpy of the liquid refrigerant is sufficiently increased or where some local pressure drops are low enough to cause the liquid refrigerant to flash. The vaporized refrigerant may separate from walls of the compressor and/or walls of an impeller and destabilize the flow within the compressor. Furthermore, the unbalance of heat exchange can also cause tubes at the other end of the shell-and-tube flooded type evaporator to be poorly wetted as the process fluid to refrigerant temperature difference is significantly reduced and very little vapor is being generated. Therefore, liquid refrigerant is not lifted up to tubes higher in the bundle for heat exchange.

An apparatus, system, and method of separating and directing process fluid flow via the use of both low pressure drop redirect pipes and high performance tubes within an evaporator are disclosed. A portion of the process fluid is carried from the process fluid inlet to one location of the evaporator shell via heat exchange tubes for heat exchange, and then is redirected from that location to the process fluid outlet via redirect pipe(s). Another portion of the process fluid is redirected from the process fluid inlet to another location of the evaporator shell via redirect pipe(s), and then is carried from that location to the process fluid outlet via heat exchange tubes for heat exchange.

In one embodiment, a portion of process fluid flows through heat exchange tubes from the process fluid entering end of the evaporator shell to the other end. Near the entering end, the temperature difference between the process fluid and the refrigerant may be the highest. Therefore heat transfer rates (vapor generation) may be the highest, and an area of high heat flux can be created. The tubes are wetted by the liquid refrigerant, heat exchange between the liquid refrigerant and the process fluid occurs, the liquid refrigerant is vaporized, and some liquid refrigerant can be lifted up to tubes higher in the bundle by the vapor. This portion of process fluid is then redirected by a low pressure drop redirect pipe back to the process fluid entering end of the shell. A second portion of process fluid is redirected by a low pressure drop redirect pipe from the process fluid entering end of the evaporator shell to the other end without substantially changing temperature of the second portion of process fluid. At the other end, the second portion of process fluid flows into a second set of heat exchange tubes and back to the entering end, and another area of high heat flux can be created. This configuration can balance heat transfer rates (vapor generation) at both ends of the evaporator, facilitate refrigerant wetting throughout the tube bundle while reducing the incidence of liquid refrigerant carry over into the compressor.

In one embodiment, an evaporator with redirected process fluid flow includes a shell; the shell has a first end and a second end; the shell includes a process fluid inlet and a process fluid outlet; and the process fluid inlet and the process fluid outlet are located at the first end of the shell. The evaporator also includes a plurality of tubes disposed within the shell and carrying a process fluid; the plurality of tubes includes a first plurality of tubes and a second plurality of tubes. The evaporator further includes a plurality of redirect pipes disposed within the shell and carrying the process fluid; the plurality of redirect pipes includes a first redirect pipe and a second redirect pipe.

In an embodiment, process fluid enters the process fluid inlet; a first portion of the process fluid enters the first plurality of tubes from the process fluid inlet; and a second portion of the process fluid enters the first redirect pipe from the process fluid inlet. Process fluid from the second plurality of tubes and process fluid from the second redirect pipe are combined at the process fluid outlet before passing out of the shell. The first plurality of tubes is in fluid communication with the second redirect pipe at the second end so that the first plurality of tubes redirect the process fluid from the process fluid inlet to the second redirect pipe and then from the second redirect pipe to the process fluid outlet. The second plurality of tubes is in fluid communication with the first redirect pipe at the second end so that the first redirect pipe redirects the process fluid from the process fluid inlet to the second plurality of tubes and then the process fluid is directed from the second plurality of tubes to the process fluid outlet.

In one embodiment, an evaporator with redirected process fluid flow functions by separating and directing process fluid (for example, water) flow into multiple portions via the use of both pipes and tubes. In an embodiment, the process fluid is separated into two portions. In an embodiment, the tubes can be high performance tubes, which typically have higher heat exchange coefficient than the low pressure drop pipes. More specifically, in such embodiment, a first portion, for example, roughly half, of the water entering the first end of the evaporator passes directly into a first plurality of heat transfer tubes and is cooled by refrigerant as the water flows to the second end of the evaporator. In an embodiment, the first portion of the water is then returned to the first end of the evaporator via the second redirect pipe. In an embodiment, a second portion of the water passes first through the first redirect pipe which brings the second portion of the water to the second end of the evaporator without substantially changing the second portion of the water's temperature. In one embodiment, the second portion of the water then enters the second plurality of tubes and is cooled by the refrigerants as the water flows back to the first end of the evaporator. In one embodiment, the two portions of the cooled water are recombined at the first end of the evaporator before passing out of the evaporator.

BRIEF DESCRIPTION OF THE DRAWINGS

References are made to the accompanying drawings that form a part of this disclosure and which illustrate embodiments in which the systems and methods described in this specification can be practiced.

Like reference numbers represent like parts throughout.

DETAILED DESCRIPTION

Figure 1A:
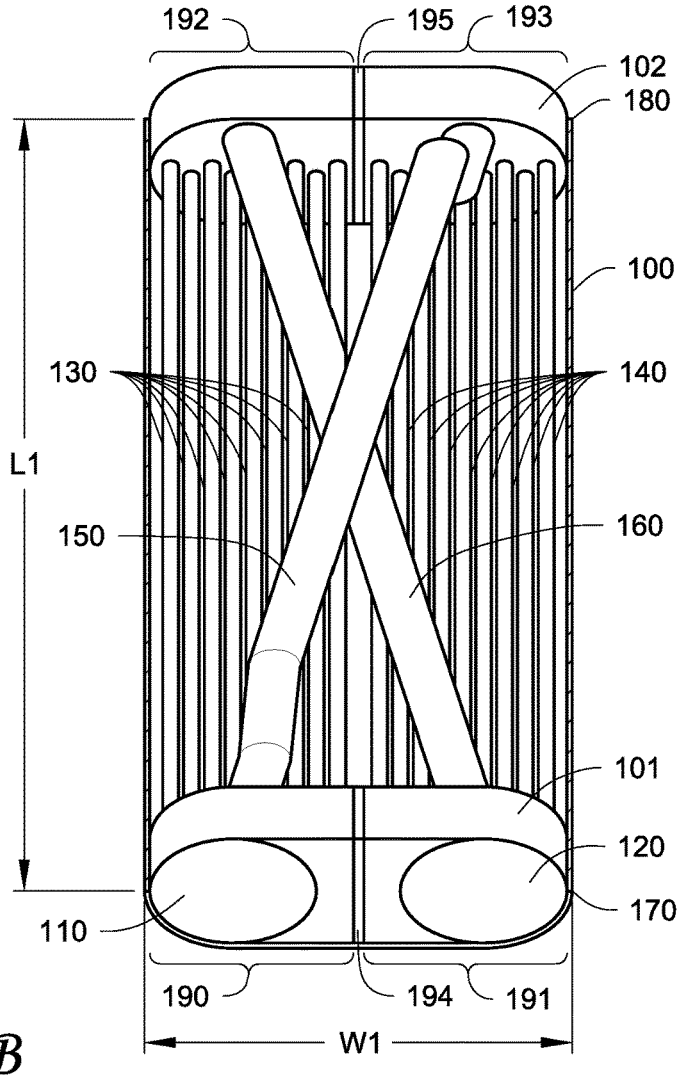
FIG. 1A is a top perspective view of a configuration of tubes, redirect pipes, and water boxes within a refrigerant evaporator shell, according to some embodiments.

This disclosure relates generally to refrigerant evaporators. More specifically, the disclosure relates to an apparatus, system, and method of separating and directing process fluid flow via the use of both redirect pipes and heat exchange tubes within the shell of a refrigerant evaporator. In an embodiment, the redirect pipes may be placed on the outside of the shell of the evaporator.

In one embodiment, a portion of process fluid flows through heat exchange tubes from the process fluid entering end of the evaporator shell to the other end. Near the entering end, the temperature difference between the process fluid and the refrigerant may be the highest. Therefore heat transfer rates (vapor generation) may be the highest, and an area of high heat flux can be created. The tubes are wetted by the liquid refrigerant, heat exchange between the liquid refrigerant and the process fluid occurs, the liquid refrigerant is vaporized, and some liquid refrigerant can be lifted up to tubes higher in the bundle by the vapor. This portion of process fluid is then redirected by a low pressure drop redirect pipe back to the process fluid entering end of the shell. A second portion of process fluid is redirected by a low pressure drop redirect pipe from the process fluid entering end of the evaporator shell to the other end without substantially changing temperature of the second portion of process fluid. At the other end, the second portion of process fluid flows into a second set of heat exchange tubes and back to the entering end, and another area of high heat flux can be created. This configuration can balance heat transfer rates (vapor generation) at both ends of the evaporator, facilitate refrigerant wetting throughout the tube bundle while reducing the incidence of liquid refrigerant carry over into the compressor.

Typically tubes within a refrigerant evaporator are used to carry process fluid such as water. For a two-pass shell-and-tube flooded type evaporator, the tubes extend horizontally from the first end of the evaporator to the second end, and both the water inlet and the water outlet are at the first end of the evaporator. The tubes are configured to have water flowing first in one direction, for example, away from the first end of the evaporator, and then in a second direction, for example, back toward the first end. This arrangement can have water pass the evaporator twice.

Advances in evaporator tube technology have produced very high performance tubes which can create large amounts of heat transfer with a minimum amount of copper usage. The use of high performance tubes can offer the potential for evaporator cost reduction via several mechanisms. Fewer tubes may be needed to produce the same heat transfer rates, the size of the evaporator can be smaller as fewer tubes are needed to be enclosed by the shell, and less refrigerant may be needed as less tube surface area needs to be wetted.

With highly enhanced tubes, most of the heat transfer may be susceptible to take place in the first pass, and where the second pass may have less or minimal impact on the heat transfer. The second pass may reduce approach temperatures slightly but may also add water pressure drop. As an example, with low pressure refrigerants, heat transfer rates decrease rapidly with reduced heat flux where, in some scenarios, where the advantages of high performance tubes may not be optimized. Further, high performance tubes might create carry over problems: high performance tubes might shift a larger portion of the total capacity to the process fluid entering portion of the evaporator, which can cause carry over, for example, as smaller sizes of the evaporator shell or as a smaller number of tubes are used.

Choosing the number and performance of evaporator tubes can contribute to factors regarding performance and cost related metrics of the evaporator. To leverage improved tube technology, such as the high performance tubes, into reduced cost evaporators, some options can be adopted. One option can be using evaporators that have shorter length than conventional two-pass shell-and-tube flooded type evaporators. This option might be possible for some configurations but may need substantial redesign work particularly when the evaporator is assembled with other components of the chiller, and this option sometimes may not be possible for evaporators of higher capacity.

While the choice of high performance tubes might positively affect the considerations of evaporator shell size, refrigerant volumes, and copper usage, water pressure drop, balance of heat transfer rates, and tube wetting are also considerations when using such high performance tubes.

An evaporator with redirected process fluid flow is disclosed. In addition to the heat exchange tubes, two or more redirect pipes can be used and crossed inside the evaporator. The heat exchange tubes can be high performance tubes, and the redirect pipes can be low pressure drop pipes. The heat exchange tubes can have a higher heat exchange coefficient than the redirect pipes. The heat exchange tubes can have internal heat transfer rate of at or about 2000 to at or about 5000 Btu/hr/ft2/F, the redirect pipes can have at or about 20 percent of the internal heat transfer rate of the heat exchange tubes. It will be appreciated that the internal heat transfer rate of the redirect pipes could be more than or less than 20 percent of the heat exchange tubes. It will be appreciated that in some circumstances the internal heat transfer rate of the redirect pipes could be some percentage less than the heat exchange tubes. The ratio of surface area to volume of water carried can be much greater for the heat exchange tubes compared to the redirect pipes. The heat flux along the length of the redirect pipes can be relatively little compared with the heat exchange tubes. The heat exchange tubes can be made of copper and have surface enhancement, the redirect pipes can be made of steel. A redirect pipe can have a larger diameter than a heat exchange tube. The heat exchange tubes can be from at or about 0.75 inches to at or about 1 inch in diameter, the redirect pipes can be for example at or about 4 inches. It will be appreciated that the diameter of the redirect pipes can be greater than 4 inches in diameter.

In an embodiment, the entering water flow is separated into multiple portions from the process fluid inlet and directed to each end of the evaporator. In an embodiment, the process fluid is separated into two portions. In an embodiment, a first portion, for example, roughly one half, of the water enters a first plurality of tubes and is returned to the process fluid outlet after flowing through a second redirect pipe. The second portion of the water first flows through a first redirect pipe and then flows through a second plurality of tubes to return to the process fluid outlet. This configuration can create two areas of high heat flux, allow for high temperature differences at both ends of the evaporator, reduce water pressure losses, leverage high performance evaporator tubes, and reduce potential mal-distribution of refrigerant vapor generated inside of the evaporator.

By using evaporators with redirected process fluid flow, the unbalanced heat exchange at both ends of the evaporator can be solved while enhancing tube wetting. The evaporator with redirected process fluid flow can be leveraged into more capacity from a evaporator shell that is smaller in diameter (for example, at or about 10% to at or about 20% reduction in the evaporator shell diameter) than conventional two-pass shell-and-tube flooded type evaporators and better performance from the tubes within the evaporator due to better wetting. The addition of the relatively inexpensive low pressure drop pipes thus facilities a reduction in the use of expensive copper tubes while allowing a multi-faceted improvement in evaporator shell area utilization and tube performance.

The evaporator with redirected process fluid flow can balance heat transfer rates (vapor generation) at both ends of the evaporator thereby reducing the incidence of liquid refrigerant carry over into the compressor and facilitating good refrigerant wetting throughout the tube bundle. The evaporator with redirected process fluid flow can provide the user with a lower cost, more compact evaporator (for example, at or about 10% to at or about 20% reduction in the evaporator shell diameter).

FIG. 1A is a top perspective view of a configuration of tubes, redirect pipes, and water boxes within a refrigerant evaporator shell, according to some embodiments. When looking inside an evaporator shell, FIG. 1A shows two water boxes, two redirect pipes and two pluralities of heat exchange tubes. One water box is located at one end of the shell, and the other water box is located at the other end of the shell. The two redirect pipes are crossed. One end of the redirect pipes and the pluralities of heat exchange tubes are in fluid communication with one water box, and the other end of the redirect pipes and the pluralities of heat exchange tubes are in fluid communication with the other water box.

In an embodiment, a refrigerant evaporator generally includes a shell 100. The shell 100 has a length L1, a width W1, and a height. The shell 100 includes a process fluid inlet 110 and a process fluid outlet 120. A plurality of tubes is disposed within the shell 100 and carries a process fluid. The plurality of tubes includes a first plurality of tubes 130 and a second plurality of tubes 140. A plurality of redirect pipes is disposed within the shell 100 and carries the process fluid. In one embodiment, the plurality of redirect pipes includes a first redirect pipe 150 and a second redirect pipe 160. The shell 100 has a first end 170 and a second end 180. The process fluid inlet 110 and the process fluid outlet 120 are located at the first end 170. The first plurality of tubes 130 and the first redirect pipe 150 connect to a first section 190 of a first water box 101 at the process fluid inlet 110. The second plurality of tubes 140 and the second redirect pipe 160 connect to a second section 191 of the first water box 101 at the process fluid outlet 120. The first plurality of tubes 130 and the second redirect pipe 160 connect to a first section 192 of a second water box 102 at the second end 180 of the shell 100. The second plurality of tubes 140 and the first redirect pipe 150 connect to a second section 193 of the second water box 102 at the second end 180 of the shell 100. In one embodiment, the first water box 101 is fluidly separated by a first separator 194 into the first section 190 and the second section 191. The second water box 102 is fluidly separated by a second separator 195 into the first section 192 and the second section 193.

Figure 1B:
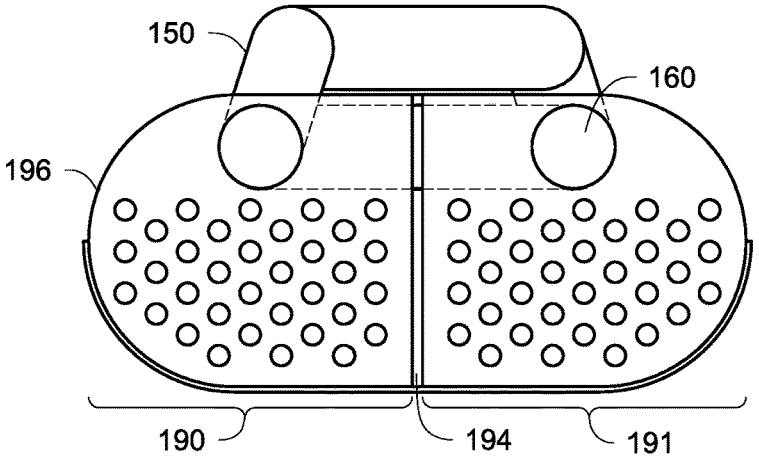
FIG. 1B is an end perspective view of the configuration of tube sheet and pipes, according to some embodiments.

FIG. 1B is an end perspective view of the configuration of tube sheet and pipes, according to some embodiments. FIG. 1B shows a tube sheet 196 at the first water box 101.

In operation, at the process fluid inlet 110, the process fluid flow, for example, water, is separated and directed into two portions. A first portion, for example, roughly half, of the process fluid, entering the first section 190 of the first water box 101 passes directly into the first plurality of heat transfer tubes 130. The first plurality of tubes 130 is in fluid communication with the second redirect pipe 160 via the first section 192 of the second water box 102 at the second end 180 so that the first plurality of tubes 130 redirect the process fluid from the process fluid inlet 110 to the second redirect pipe 160 and then the process fluid flows from the second redirect pipe 160 to the process fluid outlet 120. In other words, the first portion of the water is chilled by the refrigerant when flowing in the first plurality of tubes 130 from the first end 170 to the second end 180 and then returned to the first end 170 of the shell 100 via the second redirect pipe 160.

In an embodiment, the second portion of the water passes first through the first redirect pipe 150 which brings the second portion of the water to the second end 180 of the shell 100 without substantially changing the second portion of the water's temperature. The second plurality of tubes 140 is in fluid communication with the first redirect pipe 150 via the second section 193 of the second water box 102 at the second end 180 so that the first redirect pipe 150 redirects the process fluid from the process fluid inlet 110 to the second plurality of tubes 140 and then the process fluid flows from the second plurality of tubes 140 to the process fluid outlet 120. In other words, the second portion of the water then enters the second plurality of tubes 140 and flows back to the first end 170 of the shell 100.

In such embodiments, the first portion and the second portion of the water are recombined at the second section 191 of the first water box 101 at the first end 170 of the shell 100 before passing out of the shell 100.

In an embodiment, the plurality of tubes have a higher heat exchange coefficient than the plurality of redirect pipes. In an embodiment, the first redirect pipe 150 and the second redirect pipe 160 are crossed. In an embodiment, a portion of the first redirect pipe 150 is over a portion of the second redirect pipe 160 so as to allow the first redirect pipe 150 to cross over the second redirect pipe 160.

In an embodiment, the plurality of redirect pipes can be arranged so as to make room for more tubes, for example, to reach higher capacities in small evaporator shells.

In an embodiment, the diameter of the first redirect pipe 150 and the diameter of the first plurality of tubes 130 are configured so that a first portion, for example, about half, of the process fluid from the process fluid inlet 110 enters the first redirect pipe 150 and a second portion of the process fluid from the process fluid inlet 110 enters the first plurality of tubes 130.

In an embodiment, a first portion, for example, roughly a half, of the process fluid flows from the process fluid inlet 110 into the first plurality of tubes 130. The first portion of the process fluid flows at the second end 180 from the first plurality of tubes 130 to the second redirect pipe 160. Then the first portion of the process fluid flows from the second redirect pipe 160 to the process fluid outlet 120. In an embodiment, a second portion of the process fluid flows from the process fluid inlet 110 into the first redirect pipe 150. The second portion of the process fluid flows at the second end 180 from the first redirect pipe 150 to the second plurality of tubes 140. Then the second portion of the process fluid flows from the second plurality of tubes 140 to the process fluid outlet 120. The two portions of the process fluid combine at the first end 170 of the shell and exit the shell.

Figure 2A:
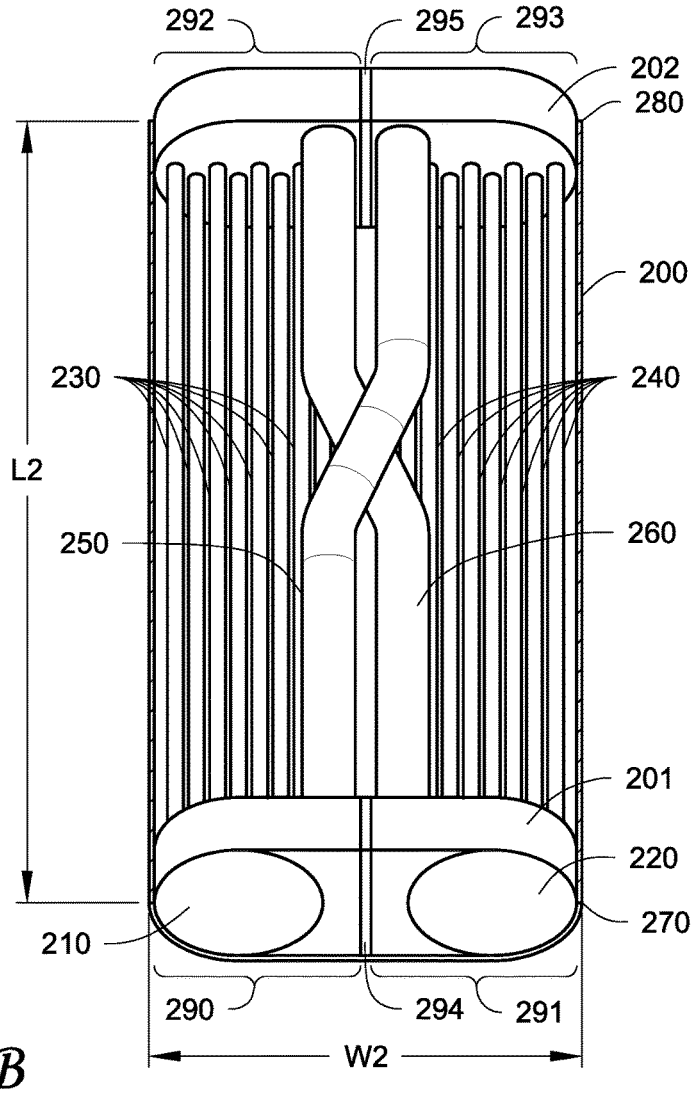
FIG. 2A is a top perspective view of another configuration of tubes, redirect pipes, and water boxes within a refrigerant evaporator shell, according to some embodiments.

FIG. 2A is a top perspective view of another configuration of tubes, redirect pipes, and water boxes within a refrigerant evaporator shell, according to some embodiments. A refrigerant evaporator generally includes a shell 200. The shell 200 has a length L2, a width W2, and a height. The shell 200 includes a process fluid inlet 210 and a process fluid outlet 220. A plurality of tubes is disposed within the shell 200 and carries a process fluid. The plurality of tubes includes a first plurality of tubes 230 and a second plurality of tubes 240. A plurality of redirect pipes is disposed within the shell 200 and carries the process fluid. In one embodiment, the plurality of redirect pipes includes a first redirect pipe 250 and a second redirect pipe 260. The shell 200 has a first end 270 and a second end 280. The process fluid inlet 210 and the process fluid outlet 220 are located at the first end 270. The first plurality of tubes 230 and the first redirect pipe 250 connect to a first section 290 of a first water box 201 at the process fluid inlet 210. The second plurality of tubes 240 and the second redirect pipe 260 connect to a second section 291 of the first water box 201 at the process fluid outlet 220. The first plurality of tubes 230 and the second redirect pipe 260 connect to a first section 292 of a second water box 202 at the second end 280 of the shell 200. The second plurality of tubes 240 and the first redirect pipe 250 connect to a second section 293 of the second water box 202 at the second end 280 of the shell 200. In one embodiment, the first water box 201 is fluidly separated by a first separator 294 into the first section 290 and the second section 291. The second water box 202 is fluidly separated by a second separator 295 into the first section 292 and the second section 293.

Figure 2B:
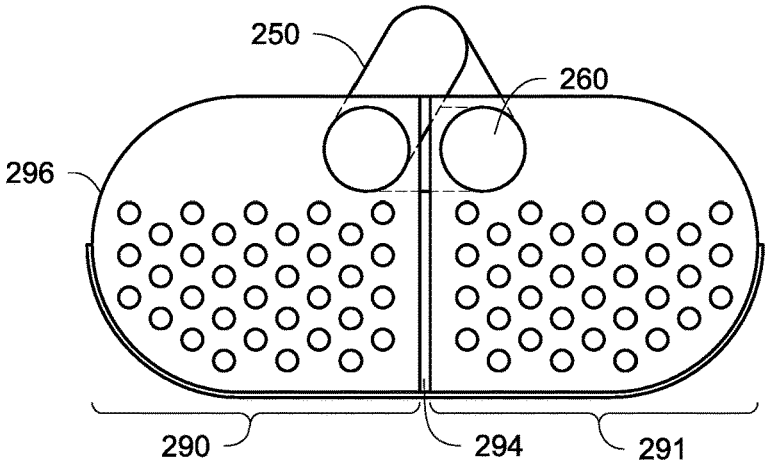
FIG. 2B is an end perspective view of the configuration of tube sheet and pipes, according to some embodiments.

FIG. 2B is an end perspective view of the configuration of tube sheet and pipes, according to some embodiments. FIG. 2B shows a tube sheet 296 at the first water box 201.

In an embodiment, the first redirect pipe 250 and the second redirect pipe 260 extend in a direction of the length L2 of the shell 200 from the first end 270 of the shell to the second end 280. The first redirect pipe 250 and the second redirect pipe 260 are configured first in parallel to each other extending from the first end 270 toward the middle of the evaporator shell 200. In an embodiment, the first redirect pipe 250 and the second redirect pipe 260 are crossed in the middle of the evaporator shell and then back in parallel to each other from the middle of the evaporator shell to the second end 280. In an embodiment, at both ends of the shell, the first redirect pipe 250 and the second redirect pipe 260 are configured side by side in the middle of the shell 200 in a direction of the width W2.

Figure 3A:
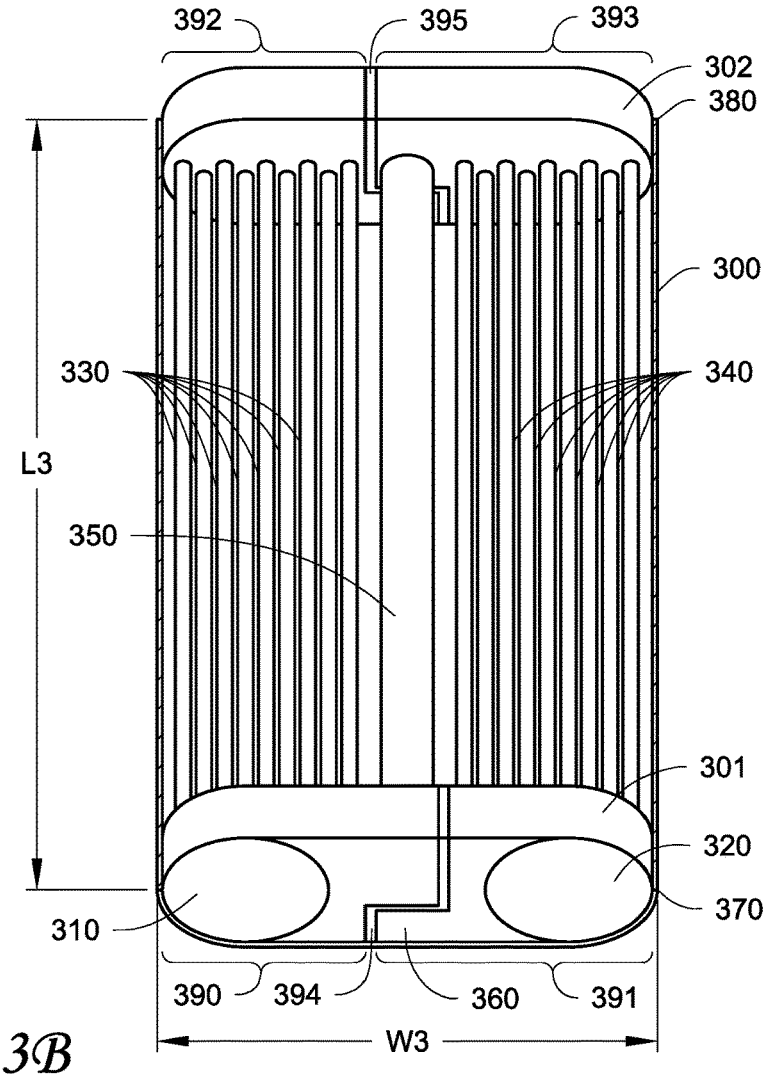
FIG. 3A is a top perspective view of yet another configuration of tubes, redirect pipes, and water boxes within a refrigerant evaporator shell, according to some embodiments.

FIG. 3A is a top perspective view of yet another configuration of tubes, redirect pipes, and water boxes within a refrigerant evaporator shell, according to some embodiments.

In one embodiment, more tubes could be packed in for higher capacities. In such an embodiment, water box based cross arrangement can be used. For example, the redirect pipes are not crossed but the water boxes can be configured to achieve the same crossing effect. The crossing can happen on the end of the evaporator within the structure and flow paths of the waterbox. In such an embodiment, pipes can be less complicated and the arrangement may simplify evaporator shell construction. In such an embodiment, at or about 40% of tubes in a conventional evaporator can be removed, at or about 4-inch diameter pipes can be used, and the tubes bundle can become deeper.

A refrigerant evaporator generally includes a shell 300. The shell 300 has a length L3, a width W3, and a height. The shell 300 includes a process fluid inlet 310 and a process fluid outlet 320. A plurality of tubes is disposed within the shell 300 and carries a process fluid. The plurality of tubes includes a first plurality of tubes 330 and a second plurality of tubes 340. A plurality of redirect pipes is disposed within the shell 300 and carries the process fluid. In one embodiment, the plurality of redirect pipes includes a first redirect pipe 350 and a second redirect pipe 360. The shell 300 has a first end 370 and a second end 380. The process fluid inlet 310 and the process fluid outlet 320 are located at the first end 370. The first plurality of tubes 330 and the first redirect pipe 350 connect to a first section 390 of a first water box 301 at the process fluid inlet 310. The second plurality of tubes 340 and the second redirect pipe 360 connect to a second section 391 of the first water box 301 at the process fluid outlet 320. The first plurality of tubes 330 and the second redirect pipe 360 connect to a first section 392 of a second water box 302 at the second end 380 of the shell 300. The second plurality of tubes 340 and the first redirect pipe 350 connect to a second section 393 of the second water box 302 at the second end 380 of the shell 300. In one embodiment, the first water box 301 is fluidly separated by a first separator 394 into the first section 390 and the second section 391. The second water box 302 is fluidly separated by a second separator 395 into the first section 392 and the second section 393.

Figure 3B:
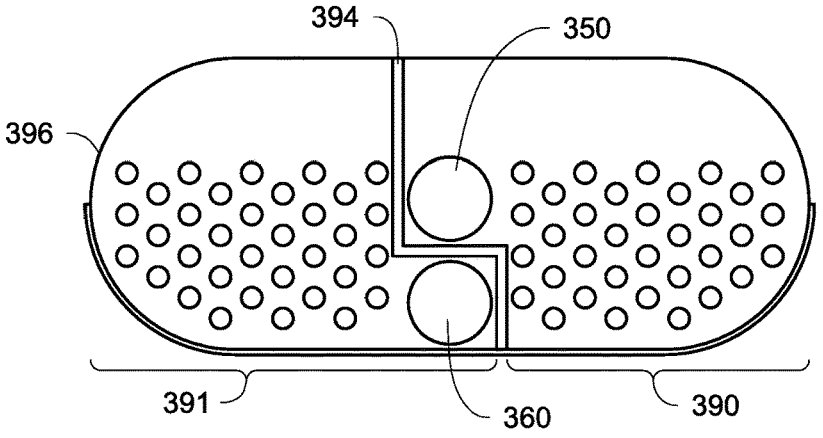
FIG. 3B is an end perspective view of the configuration of tube sheet and pipes, according to some embodiments.

FIG. 3B is an end perspective view of the configuration of tube sheet and pipes, according to some embodiments. FIG. 3B shows a tube sheet 396 at the first water box 301.

In an embodiment, the first redirect pipe 350 and the second redirect pipe 360 extend in parallel to each other in a direction of the length L3 of the shell 300 from the first end 370 of the shell 300 to the second end 380. In an embodiment, the first redirect pipe 350 and the second redirect pipe 360 are configured so that one redirect pipe is substantially and/or completely under the other redirect pipe. In an embodiment, at both ends of the shell, the first redirect pipe 350 and the second redirect pipe 360 are configured one over the other in the middle of the shell 300 in a direction of the width W3.

Figure 4A:
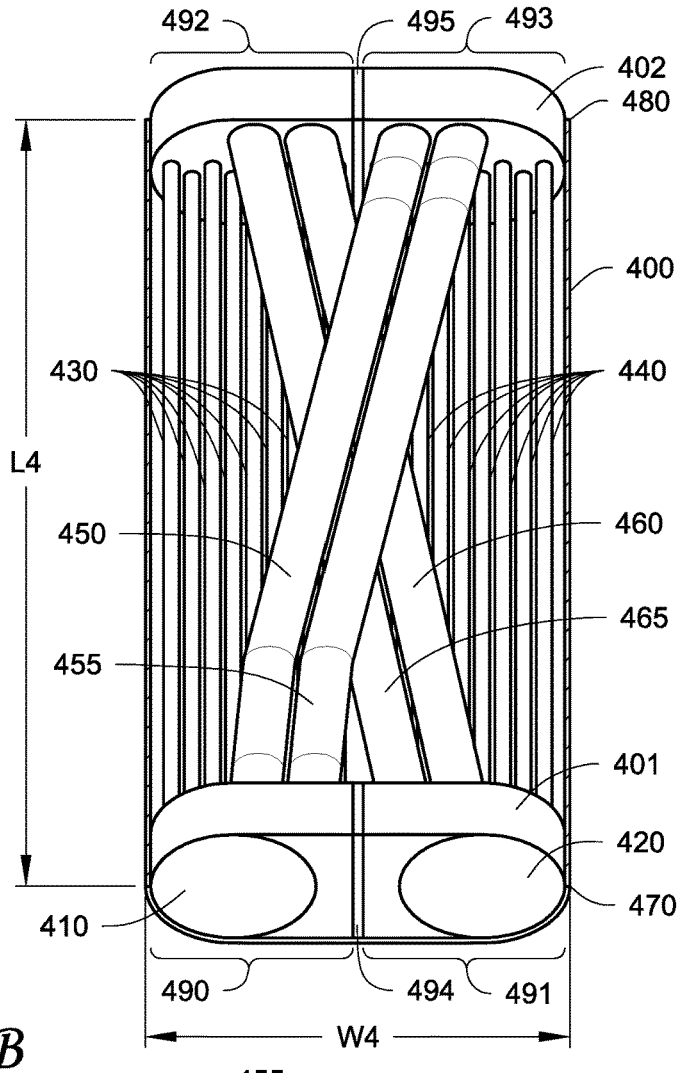
FIG. 4A is a top perspective view of yet another configuration of tubes, redirect pipes, and water boxes within a refrigerant evaporator shell, according to some embodiments.

FIG. 4A is a top perspective view of yet another configuration of tubes, redirect pipes, and water boxes within a refrigerant evaporator shell, according to some embodiments. A refrigerant evaporator generally includes a shell 400. The shell 400 has a length L4, a width W4, and a height. The shell 400 includes a process fluid inlet 410 and a process fluid outlet 420. A plurality of tubes is disposed within the shell 400 and carries a process fluid. The plurality of tubes includes a first plurality of tubes 430 and a second plurality of tubes 440. A plurality of redirect pipes is disposed within the shell 400 and carries the process fluid. In one embodiment, the plurality of redirect pipes includes a first redirect pipe 450, a second redirect pipe 460, a third redirect pipe 455, and a fourth redirect pipe 465. The shell 400 has a first end 470 and a second end 480. The process fluid inlet 410 and the process fluid outlet 420 are located at the first end 470. The first plurality of tubes 430, the first redirect pipe 450, and the third redirect pipe 455 connect to a first section 490 of a first water box 401 at the process fluid inlet 410. The second plurality of tubes 440, the second redirect pipe 460, and the fourth redirect pipe 465 connect to a second section 491 of the first water box 401 at the process fluid outlet 420. The first plurality of tubes 430, the second redirect pipe 460, and the fourth redirect pipe 465 connect to a first section 492 of a second water box 402 at the second end 480 of the shell 400. The second plurality of tubes 440, the first redirect pipe 450, and the third redirect pipe 455 connect to a second section 493 of the second water box 402 at the second end 480 of the shell 400. In one embodiment, the first water box 401 is fluidly separated by a first separator 494 into the first section 490 and the second section 491. The second water box 402 is fluidly separated by a second separator 495 into the first section 492 and the second section 493.

Figure 4B:
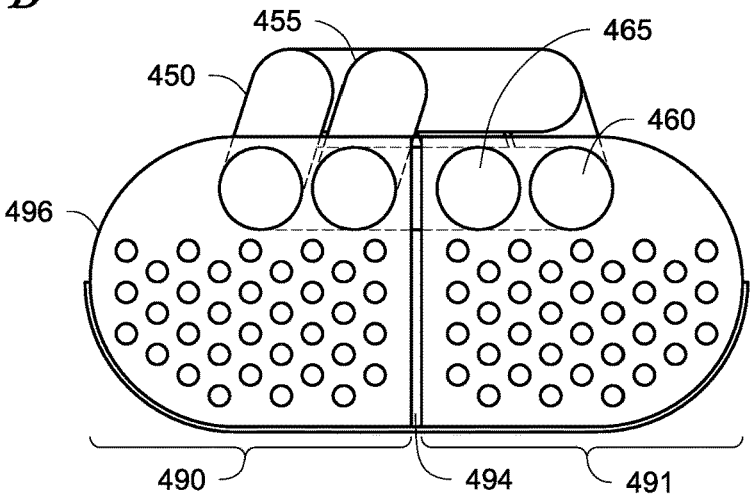
FIG. 4B is an end perspective view of the configuration of tube sheet and pipes, according to some embodiments.

FIG. 4B is an end perspective view of the configuration of tube sheet and pipes, according to some embodiments. FIG. 4B shows a tube sheet 496 at the first water box 401.

In an embodiment, the first plurality of tubes 430 is in fluid communication with the second redirect pipe 460 and the fourth redirect pipe 465 via the first section 492 of the second water box 402 at the second end 480 so that the first plurality of tubes 430 redirects the process fluid from the process fluid inlet 410 to the second redirect pipe 460 and the fourth redirect pipe 465 and then process fluid flows from the second redirect pipe 460 and the fourth redirect pipe 465 to the process fluid outlet 420.

In an embodiment, the second plurality of tubes 440 is in fluid communication with the first redirect pipe 450 and the third redirect pipe 455 via the second section 493 of the second water box 402 at the second end 480 so that the first redirect pipe 450 and the third redirect pipe 455 redirect the process fluid from the process fluid inlet 410 to the second plurality of tubes 440 and then the process fluid flows from the second plurality of tubes 440 to the process fluid outlet 420.

In an embodiment, the second redirect pipe 460 and the fourth redirect pipe 465 are in parallel to each other. In an embodiment, the first redirect pipe 450 and the third redirect pipe 455 are in parallel to each other.

In an embodiment, the first redirect pipe 450 and the second redirect pipe 460 are crossed. A portion of the first redirect pipe 450 is over a portion of the second redirect pipe 460 so as to allow the first redirect pipe 450 to cross over the second redirect pipe 460. The third redirect pipe 455 and the second redirect pipe 460 are crossed. A portion of the third redirect pipe 455 is over a portion of the second redirect pipe 460 so as to allow the third redirect pipe 455 to cross over the second redirect pipe 460.

In an embodiment, the first redirect pipe 450 and the fourth redirect pipe 465 are crossed. A portion of the first redirect pipe 450 is over a portion of the fourth redirect pipe 465 so as to allow the first redirect pipe 450 to cross over the fourth redirect pipe 465. The third redirect pipe 455 and the fourth redirect pipe 465 are crossed. A portion of the third redirect pipe 455 is over a portion of the fourth redirect pipe 465 so as to allow the third redirect pipe 455 to cross over the fourth redirect pipe 465.

Figure 5:
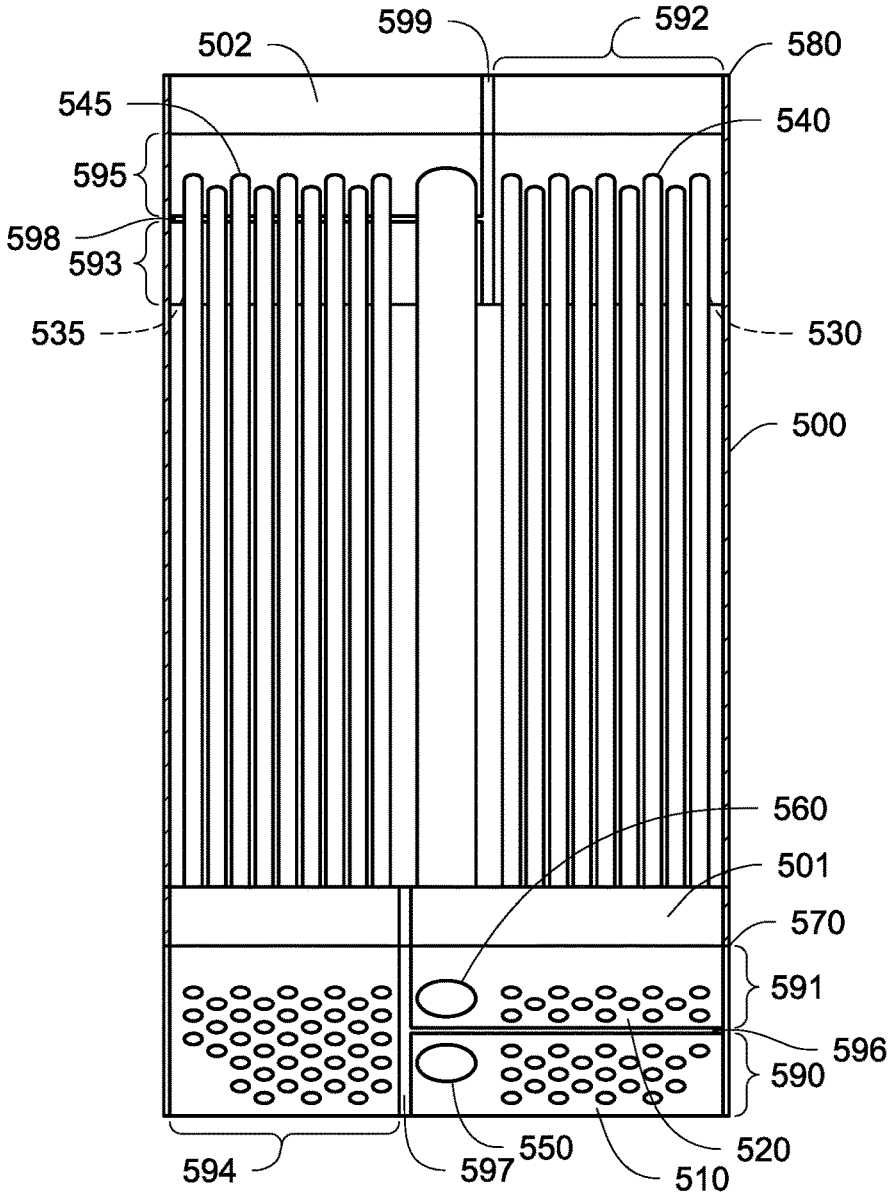
FIG. 5 illustrates a low flow configuration of tubes and pipes within a refrigerant evaporator, according to some embodiments.

FIG. 5 illustrates a low flow configuration of tubes and pipes within a refrigerant evaporator, according to some embodiments. Such configuration can advantageously distribute the regions of high heat flux at both ends of the evaporator. In such embodiments, a refrigerant evaporator generally includes a shell 500. The shell 500 includes a process fluid inlet 510 and a process fluid outlet 520. A plurality of tubes is disposed within the shell 500 and carries a process fluid. The plurality of tubes includes a first plurality of tubes 530, a second plurality of tubes 540, a third plurality of tubes 535, and a fourth plurality of tubes 545. A plurality of redirect pipes is disposed within the shell 500 and carries the process fluid. The plurality of redirect pipes includes a first redirect pipe 550 and a second redirect pipe 560. The shell has a first end 570 and a second end 580. The process fluid inlet 510 and the process fluid outlet 520 are located at the first end 570.

The first plurality of tubes 530 and the first redirect pipe 550 connect to a first section 590 of a first water box 501 at the process fluid inlet 510. The second plurality of tubes 540 and the second redirect pipe 560 connect to a second section 591 of the first water box 501 at the process fluid outlet 520. The first plurality of tubes 530 and the second plurality of tubes 540 connect to a first section 592 of a second water box 502 at the second end 580 of the shell 500. The first redirect pipe 550 and the third plurality of tubes 535 connect to a second section 593 of the second water box 502 at the second end 580 of the shell 500. The third plurality of tubes 535 and the fourth plurality of tubes 545 connect to a third section 594 of the first water box 501 at the first end 570 of the shell 500. The fourth plurality of tubes 545 and the second redirect pipe 560 connect to a third section 595 of the second water box 502 at the second end 580 of the shell 500. In one embodiment, the first water box 501 is fluidly separated by a first separator 596 and a second separator 597 into the first section 590, the second section 591, and the third section 594. The second water box 502 is fluidly separated by a third separator 598 and a fourth separator 599 into the first section 592, the second section 593, and the third section 595.

The first plurality of tubes 530 is in fluid communication with the second plurality of tubes 540 via the first section 592 of the second water box 502 at a second end 580 so that the first plurality of tubes 530 redirects the process fluid from the process fluid inlet 510 to the second plurality of tubes 540 and then the process fluid flows from the second plurality of tubes 540 to the process fluid outlet 520.

The third plurality of tubes 535 is in fluid communication with the first redirect pipe 550 via the second section 593 of the second water box 502 at the second end 580 so that the first redirect pipe 550 redirects the process fluid from the process fluid inlet 510 to the third plurality of tubes 535.

The third plurality of tubes 535 is in fluid communication with the fourth plurality of tubes 545 via the third section 594 of the first water box 501 at the first end 570 so that the third plurality of tubes 535 redirects the process fluid from the third plurality of tubes 535 to the fourth plurality of tubes 545. The fourth plurality of tubes 545 is in fluid communication with the second redirect pipe 560 via the third section 595 of the second water box 502 at the second end 580 so that the second redirect pipe 560 redirects the process fluid from the fourth plurality of tubes 545 to the process fluid outlet 520.

In an embodiment, process fluid enters the process fluid inlet 510 at the first section 590 of the first water box 501 at the first end 570 of the shell 500. A first portion, for example, greater than half, of the process fluid flows through the first plurality of tubes 530, reaches the first section 592 of the second water box 502 at the second end 580 of the shell 500, and returns to the second plurality of tubes 540 and reaches the second section 591 of the first water box 501 at the first end 570 of the shell.

The remainder of the process fluid enters the first redirect pipe 550 from the first section 590 of the first water box 501 to flow to the second section 593 of the second water box 502 at the second end 580 of the shell 500, then passes into the third plurality of tubes 535 to reach the third section 594 of the first water box 501 at the first end 570 of the shell 500, and then flows into the fourth plurality of tubes 545 and reaches the third section 595 of the second water box 502 at the second end 580 of the shell 500, and finally enters the second redirect pipe 560 to flow back to the second section 591 of the first water box 501 at the first end 570 of the shell.

The two portions of the process fluid combine in the second section 591 of the first water box 501 at the first end 570 of the shell 500 and exit the shell 500 as cooled water. In such embodiments, the second portion of the process fluid travels through both the first redirect pipe 550 and the second redirect pipe 560 while the first portion of the process fluid does not travel through any of the redirect pipes at all. The redirect pipes could result in additional water pressure drop which could result in a flow unbalance and need to be managed.

Figure 6:
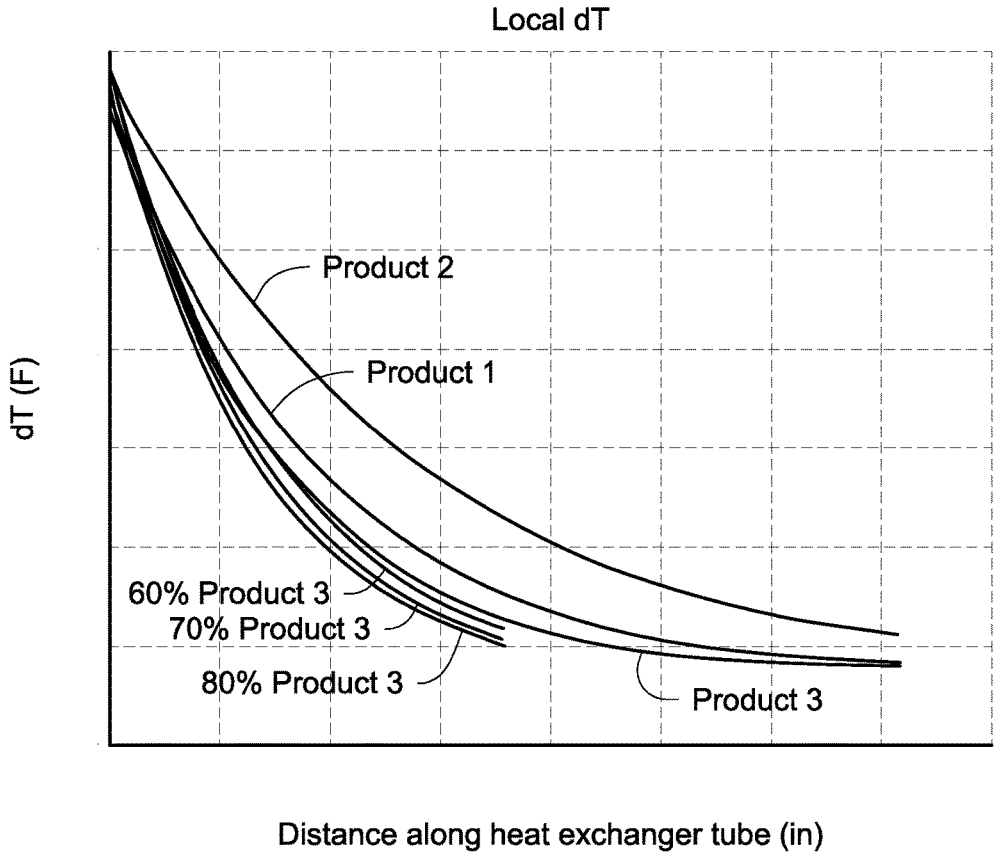
FIG. 6 is a characteristic view of distances along heat exchange tube and the prosess fluid to refrigerant temperature difference, according to some embodiments.

FIG. 6 is a characteristic view of distances along heat exchange tube and the process fluid to refrigerant temperature difference, according to some embodiments. FIG. 6 shows a process fluid to refrigerant temperature difference curve for product 3 (labeled as "Product 3"), which is a high performance heat exchange tube, in an evaporator without redirected process fluid flow. FIG. 6 also shows a process fluid to refrigerant temperature difference curve for product 2 (labeled as "Product 2"), which is a standard performance heat exchange tube, in an evaporator without redirected process fluid flow. FIG. 6 further shows a process fluid to refrigerant temperature difference curve for product 3 in an evaporator with redirected process fluid flow (labeled as "60% Product 3"). In an evaporator with redirected process fluid flow, at or about 40% of heat exchange tubes, for example, product 3, can be removed from major tube bundle compared to product 3 used in an evaporator without redirected process fluid flow. As shown in FIG. 6, in an evaporator with redirected process fluid flow, product 1 can achieve same approach temperature as product 2 in about half of the total heat exchange flow length with at or about 60% of the tube count.

As a comparison, FIG. 6 shows another process fluid to refrigerant temperature difference curve for product 3 in an evaporator with redirected process fluid flow (labeled as "70% Product 3"). In an evaporator with redirected process fluid flow, at or about 30% of heat exchange tubes, for example, product 3, can be removed from major tube bundle compared to product 3 used in an evaporator without redirected process fluid flow. FIG. 6 further shows yet another process fluid to refrigerant temperature difference curve for product 3 in an evaporator with redirected process fluid flow (labeled as "80% Product 3"). In an evaporator with redirected process fluid flow, at or about 20% of heat exchange tubes, for example, product 3, can be removed from major tube bundle compared to product 3 used in an evaporator without redirected process fluid flow. In addition, FIG. 6 shows a process fluid to refrigerant temperature difference curve for product 1 (labeled as "Product 1"), which is another high performance heat exchange tube, in an evaporator without redirected process fluid flow. Product 1 has similar temperature profiles to product 3.

Figure 7:
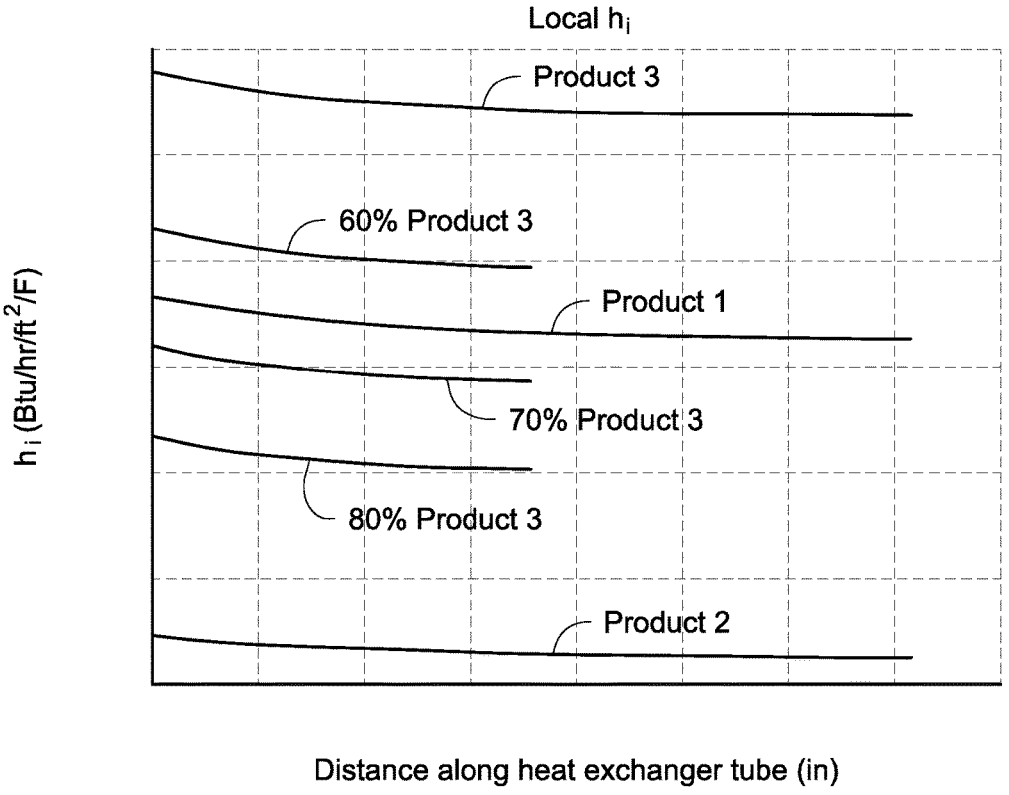
FIG. 7 is a characteristic view of distances along heat exchange tube and the internal performance of the heat exchange tubes, according to some embodiments.

FIG. 7 is a characteristic view of distances along heat exchange tube and the internal heat transfer performance (which is a function of both the water velocity and the internal enhancement of the tube) of the heat exchange tubes, according to some embodiments. FIG. 7 shows an internal performance curve for product 3 (labeled as "Product 3"), which is a high performance heat exchange tube, in an evaporator without redirected process fluid flow. FIG. 7 also shows an internal performance curve for product 2 (labeled as "Product 2"), which is a standard performance heat exchange tube, in an evaporator without redirected process fluid flow. FIG. 7 further shows an internal performance curve for product 3 in an evaporator with redirected process fluid flow (labeled as "60% Product 3"). In an evaporator with redirected process fluid flow, at or about 40% of heat exchange tubes, for example, product 3, can be removed from major tube bundle compared to product 3 used in an evaporator without redirected process fluid flow. As shown in FIG. 7, in an evaporator with redirected process fluid flow, with at or about 60% of the tube count, product 3 still have much higher internal performance than product 2.

As a comparison, FIG. 7 shows another internal performance curve for product 3 in an evaporator with redirected process fluid flow (labeled as "70% Product 3"). In an evaporator with redirected process fluid flow, at or about 30% of heat exchange tubes, for example, product 3, can be removed from major tube bundle compared to product 3 used in an evaporator without redirected process fluid flow. FIG. 7 further shows yet another internal performance curve for product 3 in an evaporator with redirected process fluid flow (labeled as "80% Product 3"). In an evaporator with redirected process fluid flow, at or about 20% of heat exchange tubes, for example, product 3, can be removed from major tube bundle compared to product 3 used in an evaporator without redirected process fluid flow. In addition, FIG. 7 shows an internal performance curve for product 1 (labeled as "Product 1"), which is another high performance heat exchange tube, in an evaporator without redirected process fluid flow. Product 1 has similar temperature profiles to product 3.

Figure 8:
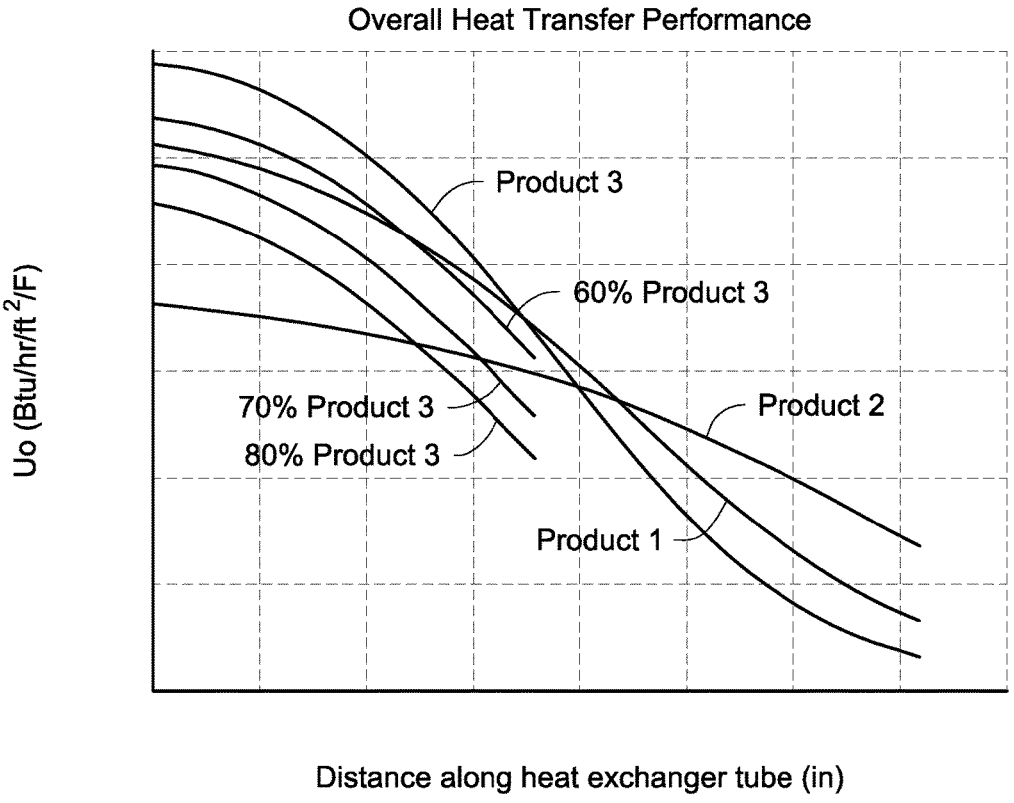
FIG. 8 is a characteristic view of distances along heat exchange tube and the overall performance of the heat exchange tubes, according to some embodiments.

FIG. 8 is a characteristic view of distances along heat exchange tube and the overall heat transfer performance (the internal performance and the external performance) of the heat exchange tubes, according to some embodiments. FIG. 8 shows an overall performance curve for product 3 (labeled as "Product 3"), which is a high performance heat exchange tube, in an evaporator without redirected process fluid flow. FIG. 8 also shows an overall performance curve for product 2 (labeled as "Product 2"), which is a standard performance heat exchange tube, in an evaporator without redirected process fluid flow. FIG. 8 further shows an overall performance curve for product 3 in an evaporator with redirected process fluid flow (labeled as "60% Product 3"). In an evaporator with redirected process fluid flow, at or about 40% of heat exchange tubes, for example, product 3, can be removed from major tube bundle compared to product 3 used in an evaporator without redirected process fluid flow. As shown in FIG. 8, in an evaporator with redirected process fluid flow, with at or about 60% of the tube count, product 3 would have higher average overall heat transfer performance than product 2.

As a comparison, FIG. 8 shows another overall performance curve for product 3 in an evaporator with redirected process fluid flow (labeled as "70% Product 3"). In an evaporator with redirected process fluid flow, at or about 30% of heat exchange tubes, for example, product 3, can be removed from major tube bundle compared to product 3 used in an evaporator without redirected process fluid flow. FIG. 8 further shows yet another overall performance curve for product 3 in an evaporator with redirected process fluid flow (labeled as "80% Product 3"). In an evaporator with redirected process fluid flow, at or about 20% of heat exchange tubes, for example, product 3, can be removed from major tube bundle compared to product 3 used in an evaporator without redirected process fluid flow. In addition, FIG. 8 shows an overall performance curve for product 1 (labeled as "Product 1"), which is another high performance heat exchange tube, in an evaporator without redirected process fluid flow. Product 1 has similar temperature profiles to product 3.

Some analysis and test results show that an evaporator with redirected process fluid flow can achieve the same approach temperature as conventional two-pass shell-and-tube flooded type evaporators using the same types of tubes, but evaporators with an evaporator with redirected process fluid flow need only at or about 60% of the tube count in conventional evaporators, and the overall heat transfer rates in evaporators with an evaporator with redirected process fluid flow maintain high throughout the tube bundle. The results may be because high internal heat transfer rates maintain good heat transfer even in one pass configurations; because by reducing area of tube bundles, heat fluxes can stay high keeping refrigerant side heat transfer rates high; and/or because as tube bundle height is expected to be lower, tube bundle effects can be also lessened. For example, when tube bundle height is lower, liquid refrigerant may be less susceptible to be carried over the top of the tube bundle and passed into the compressor. Therefore, for example, as discussed before, tube bundle effects such as the undesirable losses and disruption of vapor flows caused by the liquid refrigerant evaporates inside the compressor can be lessened.

In one embodiment, two at or about 4-inch diameter low pressure drop pipes can be used in an evaporator with redirected process fluid flow. In such embodiment, at or about 40% of tubes in conventional evaporators can be removed from major tube bundle, and plenty of room for more tubes are available (for example, to reach higher capacities in small evaporator shells) if pipes were to be better arranged. In such embodiment, segregated water box on both ends can be used.

In one embodiment, four at or about 8-inch diameter low pressure drop pipes can be used in an evaporator with redirected process fluid flow. In such embodiment, at or about 40% of tubes in conventional evaporator can be removed from major tube bundle. In such embodiment, segregated water box and standard side by side water boxes on both ends can be used. In an embodiment, six at or about 6-inch diameter pipes may also work and be more compact.

Figure 9:
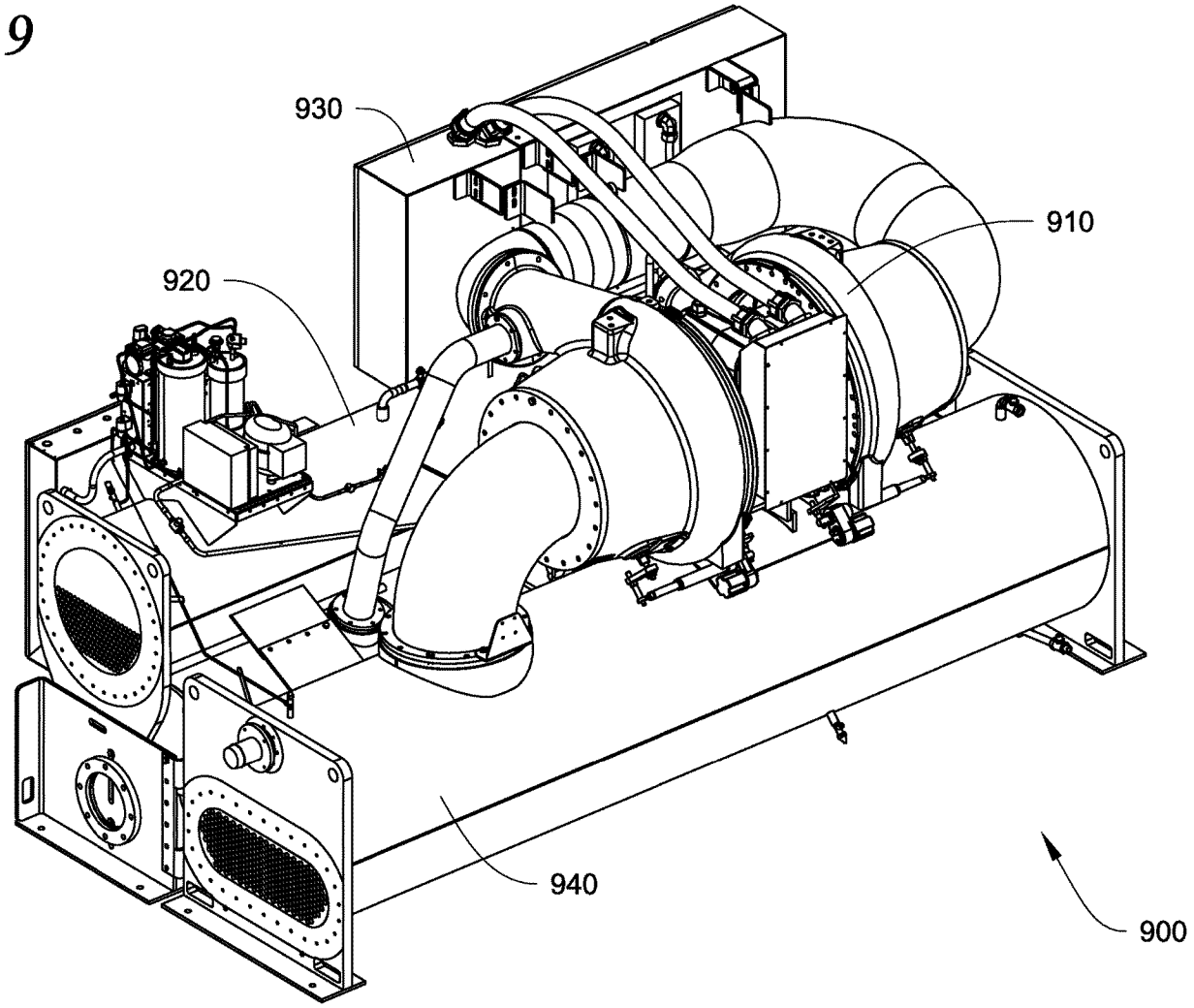
FIG. 9 illustrates a refrigerant evaporator with redirected process flow in an HVAC system, according to some embodiments.

FIG. 9 illustrates a refrigerant evaporator with redirected process flow in an HVAC system, according to some embodiments. A heating, ventilation, air conditioning (HVAC) unit 900 for an HVAC system generally includes a compressor 910, a condenser 920 fluidly connected to the compressor 910, a unit controller 930, and a refrigerant evaporator 940 fluidly connected to the condenser 920. A control system 930 may control an operation of the HVAC unit 900. It is to be appreciated that the refrigerant evaporator 940 can be any one of the above mentioned evaporator embodiments.

In an embodiment, water box configurations may be used to accomplish the counter flow described in any one of the above mentioned evaporator embodiments.

ASPECTS

It is to be appreciated that any one or more of aspects 1-6 can be combined with any one or more of aspects 7-14. It is also to be appreciated that aspect 7 can be combined with any one or more of aspects 8-14. It is further to be appreciated that 8 can be combined with any one or more of aspects 9-14.

Aspect 1. A refrigerant evaporator comprising:

a shell including a process fluid inlet and a process fluid outlet;

a plurality of tubes disposed within the shell and carrying a process fluid including a first plurality of tubes and a second plurality of tubes; and a plurality of redirect pipes disposed within the shell and carrying the process fluid including a first redirect pipe and a second redirect pipe;

wherein the shell having a first end and a second end, the process fluid inlet and the process fluid outlet being located at the first end, the first plurality of tubes being in fluid communication with the second redirect pipe at the second end so that the first plurality of tubes redirect the process fluid from the process fluid inlet to the second redirect pipe and then from the second redirect pipe to the process fluid outlet, and the second plurality of tubes being in fluid communication with the first redirect pipe at the second end so that the first redirect pipe redirects the process fluid from the process fluid inlet to the second plurality of tubes and then from the second plurality of tubes to the process fluid outlet.

Aspect 2. The refrigerant evaporator of aspect 1, wherein the plurality of tubes having higher heat exchange coefficient than the plurality of redirect pipes.

Aspect 3. The refrigerant evaporator of aspect 1 or 2, wherein the first redirect pipe and the second redirect pipe being crossed.

Aspect 4. The refrigerant evaporator of any one of aspects 1-3, wherein the diameter of the first redirect pipe and the diameter of the first plurality of tubes are configured so that about half of the process fluid from the process fluid inlet enters the first redirect pipe and about half of the process fluid from the process fluid inlet enters the first plurality of tubes.

Aspect 5. The refrigerant evaporator of any one of aspects 1-4, wherein the plurality of redirect pipes having a third redirect pipe and a fourth redirect pipe, the first plurality of tubes being in fluid communication with the second redirect pipe and the fourth redirect pipe at the second end so that the first plurality of tubes redirects the process fluid from the process fluid inlet to the second redirect pipe and the fourth redirect pipe and then from the second redirect pipe and the fourth redirect pipe to the process fluid outlet, and the second plurality of tubes being in fluid communication with the first redirect pipe and the third redirect pipe at the second end so that the first redirect pipe and the third redirect pipe redirect the process fluid from the process fluid inlet to the second plurality of tubes and then from the second plurality of tubes to the process fluid outlet.

Aspect 6. The refrigerant evaporator of aspect 5, wherein the first redirect pipe and the third redirect pipe being in parallel, the second redirect pipe and the fourth redirect pipe being in parallel, and the first redirect pipe and the second redirect pipe being crossed.

Aspect 7. A refrigerant evaporator comprising:

a shell including a process fluid inlet and a process fluid outlet;

a plurality of tubes disposed within the shell and carrying a process fluid including a first plurality of tubes, a second plurality of tubes, a third plurality of tubes, and a fourth plurality of tubes; and a plurality of redirect pipes disposed within the shell and carrying the process fluid including a first redirect pipe and a second redirect pipe;

wherein the shell having a first end and a second end, the process fluid inlet and the process fluid outlet being located at the first end, the first plurality of tubes being in fluid communication with the second plurality of tubes at the second end so that the first plurality of tubes redirects the process fluid from the process fluid inlet to the second plurality of tubes and then from the second plurality of tubes to the process fluid outlet, the third plurality of tubes being in fluid communication with the first redirect pipe at the second end so that the first redirect pipe redirects the process fluid from the process fluid inlet to the third plurality of tubes, the third plurality of tubes being in fluid communication with the fourth plurality of tubes at the first end so that the third plurality of tubes redirects the process fluid from the third plurality of tubes to the fourth plurality of tubes, the fourth plurality of tubes being in fluid communication with the second redirect pipe at the second end so that the second redirect pipe redirects the process fluid from the fourth plurality of tubes to the process fluid outlet.

Aspect 8. A method of directing a process fluid in a refrigerant evaporator that comprises a shell including a process fluid inlet and a process fluid outlet;

a plurality of tubes disposed within the shell and carrying a process fluid including a first plurality of tubes and a second plurality of tubes; and a plurality of redirect pipes disposed within the shell and carrying the process fluid including a first redirect pipe and a second redirect pipe;

wherein the shell having a first end and a second end, the process fluid inlet and the process fluid outlet being located at the first end, the first plurality of tubes being in fluid communication with the second redirect pipe at the second end so that the first plurality of tubes redirect the process fluid from the process fluid inlet to the second redirect pipe and then from the second redirect pipe to the process fluid outlet, and the second plurality of tubes being in fluid communication with the first redirect pipe at the second end so that the first redirect pipe redirects the process fluid from the process fluid inlet to the second plurality of tubes and then from the second plurality of tubes to the process fluid outlet, comprising:

directing a first portion of the process fluid from the process fluid inlet into the first plurality of tubes to the second end;

directing the first portion of the process fluid at the second end from the first plurality of tubes to the second redirect pipe;

directing the first portion of the process fluid from the second redirect pipe to the process fluid outlet;

directing a second portion of the process fluid from the process fluid inlet into the first redirect pipe to the second end;

directing the second portion of the process fluid at the second end from the first redirect pipe to the second plurality of tubes; and directing the second portion of the process fluid from the second plurality of tubes to the process fluid outlet.

Aspect 9. A heating, ventilation, air conditioning (HVAC) unit for an HVAC system comprising:

a compressor having a motor and a drive;

a condenser fluidly connected to the compressor;

a unit controller; and a refrigerant evaporator fluidly connected to the condenser, wherein the refrigerant evaporator comprising a shell including a process fluid inlet and a process fluid outlet;

a plurality of tubes disposed within the shell and carrying a process fluid including a first plurality of tubes and a second plurality of tubes; and a plurality of redirect pipes disposed within the shell and carrying the process fluid including a first redirect pipe and a second redirect pipe;

wherein the shell having a first end and a second end, the process fluid inlet and the process fluid outlet being located at the first end, the first plurality of tubes being in fluid communication with the second redirect pipe at the second end so that the first plurality of tubes redirect the process fluid from the process fluid inlet to the second redirect pipe and then from the second redirect pipe to the process fluid outlet, the second plurality of tubes being in fluid communication with the first redirect pipe at the second end so that the first redirect pipe redirects the process fluid from the process fluid inlet to the second plurality of tubes and then from the second plurality of tubes to the process fluid outlet.

Aspect 10. The HVAC unit of aspect 9, wherein the plurality of tubes having higher heat exchange coefficient than the plurality of redirect pipes.

Aspect 11. The HVAC unit of aspect 9 or 10, wherein the first redirect pipe and the second redirect pipe being crossed.

Aspect 12. The HVAC unit of any one of aspects 9-11, wherein the diameter of the first redirect pipe and the diameter of the first plurality of tubes are configured so that about half of the process fluid from the process fluid inlet enters the first redirect pipe and about half of the process fluid from the process fluid inlet enters the first plurality of tubes.

Aspect 13. The HVAC unit of any one of aspects 9-12, wherein the plurality of redirect pipes having a third redirect pipe and a fourth redirect pipe, the first plurality of tubes being in fluid communication with the second redirect pipe and the fourth redirect pipe at the second end so that the first plurality of tubes redirects the process fluid from the process fluid inlet to the second redirect pipe and the fourth redirect pipe and then from the second redirect pipe and the fourth redirect pipe to the process fluid outlet, and the second plurality of tubes being in fluid communication with the first redirect pipe and the third redirect pipe at the second end so that the first redirect pipe and the third redirect pipe redirect the process fluid from the process fluid inlet to the second plurality of tubes and then from the second plurality of tubes to the process fluid outlet.

Aspect 14. The HVAC unit of aspect 13, wherein the first redirect pipe and the third redirect pipe being in parallel, the second redirect pipe and the fourth redirect pipe being in parallel, and the first redirect pipe and the second redirect pipe being crossed.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, indicate the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts, without departing from the scope of the present disclosure. The word "embodiment" as used within this specification may, but does not necessarily, refer to the same embodiment. This specification and the embodiments described are examples only. Other and further embodiments may be devised without departing from the basic scope thereof, with the true scope and spirit of the disclosure being indicated by the claims that follow.

The invention claimed is:

1. A refrigerant evaporator comprising:

a shell including a process fluid inlet and a process fluid outlet;

a plurality of tubes disposed within the shell and carrying a process fluid including a first plurality of tubes and a second plurality of tubes; and a plurality of redirect pipes disposed within the shell and carrying the process fluid including a first redirect pipe and a second redirect pipe;

wherein the shell having a first end and a second end, the process fluid inlet and the process fluid outlet being located at the first end, the first plurality of tubes being in fluid communication with the second redirect pipe at the second end so that the first plurality of tubes redirect the process fluid from the process fluid inlet to the second redirect pipe and then from the second redirect pipe to the process fluid outlet, and the second plurality of tubes being in fluid communication with the first redirect pipe at the second end so that the first redirect pipe redirects the process fluid from the process fluid inlet to the second plurality of tubes and then from the second plurality of tubes to the process fluid outlet.

2. The refrigerant evaporator of claim 1, wherein the plurality of tubes having higher heat exchange coefficient than the plurality of redirect pipes.

3. The refrigerant evaporator of claim 1, wherein the first redirect pipe and the second redirect pipe being crossed.

4. The refrigerant evaporator of claim 1, wherein the diameter of the first redirect pipe and the diameter of the first plurality of tubes are configured so that about half of the process fluid from the process fluid inlet enters the first redirect pipe and about half of the process fluid from the process fluid inlet enters the first plurality of tubes.

5. The refrigerant evaporator of claim 1, wherein the plurality of redirect pipes having a third redirect pipe and a fourth redirect pipe, the first plurality of tubes being in fluid communication with the second redirect pipe and the fourth redirect pipe at the second end so that the first plurality of tubes redirects the process fluid from the process fluid inlet to the second redirect pipe and the fourth redirect pipe and then from the second redirect pipe and the fourth redirect pipe to the process fluid outlet, and the second plurality of tubes being in fluid communication with the first redirect pipe and the third redirect pipe at the second end so that the first redirect pipe and the third redirect pipe redirect the process fluid from the process fluid inlet to the second plurality of tubes and then from the second plurality of tubes to the process fluid outlet.

6. The refrigerant evaporator of claim 5, wherein the first redirect pipe and the third redirect pipe being in parallel, the second redirect pipe and the fourth redirect pipe being in parallel, and the first redirect pipe and the second redirect pipe being crossed.

7. A refrigerant evaporator comprising:

a shell including a process fluid inlet and a process fluid outlet;

a plurality of tubes disposed within the shell and carrying a process fluid including a first plurality of tubes, a second plurality of tubes, a third plurality of tubes, and a fourth plurality of tubes; and a plurality of redirect pipes disposed within the shell and carrying the process fluid including a first redirect pipe and a second redirect pipe;

wherein the shell having a first end and a second end, the process fluid inlet and the process fluid outlet being located at the first end, the first plurality of tubes being in fluid communication with the second plurality of tubes at the second end so that the first plurality of tubes redirects the process fluid from the process fluid inlet to the second plurality of tubes and then from the second plurality of tubes to the process fluid outlet, the third plurality of tubes being in fluid communication with the first redirect pipe at the second end so that the first redirect pipe redirects the process fluid from the process fluid inlet to the third plurality of tubes, the third plurality of tubes being in fluid communication with the fourth plurality of tubes at the first end so that the third plurality of tubes redirects the process fluid from the third plurality of tubes to the fourth plurality of tubes, the fourth plurality of tubes being in fluid communication with the second redirect pipe at the second end so that the second redirect pipe redirects the process fluid from the fourth plurality of tubes to the process fluid outlet.

8. A method of directing a process fluid in a refrigerant evaporator that comprises a shell including a process fluid inlet and a process fluid outlet;

a plurality of tubes disposed within the shell and carrying a process fluid including a first plurality of tubes and a second plurality of tubes; and a plurality of redirect pipes disposed within the shell and carrying the process fluid including a first redirect pipe and a second redirect pipe;

wherein the shell having a first end and a second end, the process fluid inlet and the process fluid outlet being located at the first end, the first plurality of tubes being in fluid communication with the second redirect pipe at the second end so that the first plurality of tubes redirect the process fluid from the process fluid inlet to the second redirect pipe and then from the second redirect pipe to the process fluid outlet, and the second plurality of tubes being in fluid communication with the first redirect pipe at the second end so that the first redirect pipe redirects the process fluid from the process fluid inlet to the second plurality of tubes and then from the second plurality of tubes to the process fluid outlet, comprising:

directing a first portion of the process fluid from the process fluid inlet into the first plurality of tubes to the second end;

directing the first portion of the process fluid at the second end from the first plurality of tubes to the second redirect pipe;

directing the first portion of the process fluid from the second redirect pipe to the process fluid outlet;

directing a second portion of the process fluid from the process fluid inlet into the first redirect pipe to the second end;

directing the second portion of the process fluid at the second end from the first redirect pipe to the second plurality of tubes; and directing the second portion of the process fluid from the second plurality of tubes to the process fluid outlet.

9. A heating, ventilation, air conditioning (HVAC) unit for an HVAC system comprising:

a compressor having a motor and a drive;

a condenser fluidly connected to the compressor;

a unit controller; and a refrigerant evaporator fluidly connected to the condenser, wherein the refrigerant evaporator comprising a shell including a process fluid inlet and a process fluid outlet;

a plurality of tubes disposed within the shell and carrying a process fluid including a first plurality of tubes and a second plurality of tubes; and a plurality of redirect pipes disposed within the shell and carrying the process fluid including a first redirect pipe and a second redirect pipe;

wherein the shell having a first end and a second end, the process fluid inlet and the process fluid outlet being located at the first end, the first plurality of tubes being in fluid communication with the second redirect pipe at the second end so that the first plurality of tubes redirect the process fluid from the process fluid inlet to the second redirect pipe and then from the second redirect pipe to the process fluid outlet, the second plurality of tubes being in fluid communication with the first redirect pipe at the second end so that the first redirect pipe redirects the process fluid from the process fluid inlet to the second plurality of tubes and then from the second plurality of tubes to the process fluid outlet.

10. The HVAC unit of claim 9, wherein the plurality of tubes having higher heat exchange coefficient than the plurality of redirect pipes.

11. The HVAC unit of claim 9, wherein the first redirect pipe and the second redirect pipe being crossed.

12. The HVAC unit of claim 9, wherein the diameter of the first redirect pipe and the diameter of the first plurality of tubes are configured so that about half of the process fluid from the process fluid inlet enters the first redirect pipe and about half of the process fluid from the process fluid inlet enters the first plurality of tubes.

13. The HVAC unit of claim 9, wherein the plurality of redirect pipes having a third redirect pipe and a fourth redirect pipe, the first plurality of tubes being in fluid communication with the second redirect pipe and the fourth redirect pipe at the second end so that the first plurality of tubes redirects the process fluid from the process fluid inlet to the second redirect pipe and the fourth redirect pipe and then from the second redirect pipe and the fourth redirect pipe to the process fluid outlet, and the second plurality of tubes being in fluid communication with the first redirect pipe and the third redirect pipe at the second end so that the first redirect pipe and the third redirect pipe redirect the process fluid from the process fluid inlet to the second plurality of tubes and then from the second plurality of tubes to the process fluid outlet.

14. The HVAC unit of claim 13, wherein the first redirect pipe and the third redirect pipe being in parallel, the second redirect pipe and the fourth redirect pipe being in parallel, and the first redirect pipe and the second redirect pipe being crossed.

* * * * *